US008636153B1

(12) United States Patent
Dattilo

(10) Patent No.: US 8,636,153 B1
(45) Date of Patent: Jan. 28, 2014

(54) DART AND ACCESSORIES DISPLAY SHELF

(71) Applicant: Daniel Dattilo, New Port Richey, FL (US)

(72) Inventor: Daniel Dattilo, New Port Richey, FL (US)

( * ) Notice: Subject to any disclaimer, the term of this patent is extended or adjusted under 35 U.S.C. 154(b) by 0 days.

(21) Appl. No.: 13/621,265

(22) Filed: Sep. 16, 2012

(51) Int. Cl.
*A47F 7/00* (2006.01)

(52) U.S. Cl.
USPC ..... 211/85.7

(58) Field of Classification Search
USPC ..... 211/60.1, 62, 63, 64, 66, 67, 68, 69, 211/70.3, 70.5, 70.6, 70.7, 70.8, 85.7, 211/87.01; D6/567, 574
See application file for complete search history.

(56) References Cited

U.S. PATENT DOCUMENTS

| | | | | | |
|---|---|---|---|---|---|
| D24,378 | S | * | 6/1895 | Wanderer | D6/574 |
| 713,762 | A | * | 11/1902 | Haskell | 211/14 |
| 1,697,711 | A | * | 1/1929 | Brown | 211/88.01 |
| D176,162 | S | * | 11/1955 | Steece | D6/528 |
| 2,815,863 | A | * | 12/1957 | Larson | 211/70.1 |
| 3,269,550 | A | * | 8/1966 | Marcus | 211/70.6 |
| 3,677,414 | A | * | 7/1972 | Rock | 211/85.3 |
| 3,858,725 | A | * | 1/1975 | Pietrack et al. | 211/85.7 |
| 3,913,746 | A | * | 10/1975 | Burton | 211/64 |
| 4,105,119 | A | | 8/1978 | Cowan | 206/579 |
| 4,125,192 | A | * | 11/1978 | Dayen | 211/14 |
| D260,830 | S | | 9/1981 | Trouba | D6/125 |
| 4,294,365 | A | | 10/1981 | Henderson | 211/60 R |
| 4,583,647 | A | * | 4/1986 | Schinzing | 211/60.1 |
| D290,672 | S | | 7/1987 | Pearson | D6/552 |
| D294,668 | S | * | 3/1988 | Handler et al. | D6/570 |
| D308,783 | S | | 6/1990 | Pearson | D6/552 |
| 4,941,577 | A | * | 7/1990 | Ferree et al. | 211/70.6 |
| D309,687 | S | * | 8/1990 | Embree et al. | D6/567 |
| 5,127,210 | A | | 7/1992 | Jenson | 53/467 |
| D340,606 | S | * | 10/1993 | Hubbard | D6/567 |
| D340,608 | S | * | 10/1993 | Hubbard | D6/567 |
| D341,051 | S | * | 11/1993 | Hubbard | D6/567 |
| 5,531,450 | A | | 7/1996 | Lu | 273/348 |
| D372,827 | S | * | 8/1996 | Roche et al. | D6/567 |
| 5,632,386 | A | * | 5/1997 | Gabhart | 211/85.7 |
| D392,144 | S | * | 3/1998 | Vogler | D6/574 |
| 5,743,416 | A | * | 4/1998 | Yemini | 211/70.6 |
| D394,775 | S | * | 6/1998 | Anderson et al. | D6/574 |
| 5,915,307 | A | | 6/1999 | Tisbo | 108/152 |
| 5,927,519 | A | * | 7/1999 | Koonts et al. | 211/85.7 |
| D425,349 | S | * | 5/2000 | Adkins | D6/528 |
| 6,089,383 | A | * | 7/2000 | Heneveld | 211/14 |
| D431,407 | S | * | 10/2000 | Sorensen et al. | D6/574 |
| 6,425,489 | B1 | * | 7/2002 | Cunningham | 211/70.6 |
| D487,193 | S | * | 3/2004 | Liu | D3/313 |
| 6,769,553 | B1 | * | 8/2004 | Hurt | 211/70.6 |
| 7,506,770 | B2 | * | 3/2009 | Rief | 211/70.6 |
| 7,798,336 | B2 | * | 9/2010 | Shiao | 211/70.6 |
| 2004/0055979 | A1 | * | 3/2004 | Fabregas | 211/70.6 |
| 2006/0102569 | A1 | * | 5/2006 | Laga | 211/70.6 |
| 2008/0000854 | A1 | * | 1/2008 | Rief | 211/70.6 |

* cited by examiner

*Primary Examiner* — Joshua Rodden

(57) ABSTRACT

A dart shelf designed to safely store and display darts in an upright position along with accessories involved with playing the game of darts. The dart shelf is secured to a wall and has built in openings for darts, flights, and shafts. The shelf has a recessed cut-out for storage of chalk, dart wrench, chalk eraser and dart sharpening tool.

1 Claim, 4 Drawing Sheets

DART AND ACCESSORIES DISPLAY SHELF

BACKGROUND

The game of darts involves a round board usually made of sisal rope fibers that come from the Agave plant. The board which is called a Bristle board can be mounted directly on a wall, or be placed in a wood frame or cabinet to protect the surrounding wall from damage caused by darts missing their target. The board and cabinet are mounted at a specific height. The cabinet that the dart board is mounted in usually has two doors. When in the opened position, the doors have a chalk board fastened to the inside to allow the players to keep score.

There are various games you can play by standing at a predetermined distance from the board and then throwing the darts. The board has different sections marked out with numbers and colors. Each player has three darts to throw and the total combined score of the three darts of each player is kept. The first person to reach the chosen game point total wins the game. After every game played the board is then wiped clean with a chalk eraser.

You will need to purchase a set of darts to play. They come in a set of three with extra flights and shafts in case they get damaged while playing the game. There's a tendency of flights getting damaged when throwing and hitting other darts previously thrown. The extra shafts come in a different colors: and design of the original darts that are supplied. Players like to change the look of the dart with an assortment of colors and styles that is available. In order to make these repairs or changes requires a dart wrench. This is a small metal tool which does a number of different tasks to repair the darts.

After long usage, the dart tips become dull and need to be replaced or sharpened. You will need a small sharpening tool for this.

Players who take the game more seriously will have, many dart sets in various weights and design. The flights on the end of the darts come in different shapes and designs which change the flight of the dart. Nylon flights are the most durable of the flights sold. There are also Dimplex/Riblex flights which have a bumpy surface or ribbed surface. This style flight makes the dart slightly more stable in flight. When purchasing new flights they come packed in clear plastic bags to be able to see the different shapes and designs.

The problem is what do you do with all these accessories. The only place you have to store any of these items is on the small ledge at the bottom of the cabinet. You can't lie your darts down on their sides without causing damage to the flights. They are designed to be spread open to have a proper flight when thrown. You can't leave the darts in the bristle board because they eventually get loose and fall out. Any round item like the chalk or the shafts when placed on a flat surface will roll out of the cabinet.

U.S. Pat. No. 4,294,365 Ellsworth Henderson addresses the problem by building a small shelf which you stick to the wall with adhesive strip. Although, this shelf is only designed to hold 3 darts.

A dart storage and transport apparatus and method is disclosed in U.S. Pat. No. 5,127,210 Edward Jensen shows a carrier for darts and dart parts. The carrier comprises storage compartments where by dart parts are stored separately to minimize damage. The parts are enclosed in a box and are accessed by removing covers.

SUMMARY

Therefore it is an object of the invention to provide a device to store and display darts.

It is another object of this invention to provide a place to store and display dart accessories.

It is another object of this invention to provide a device to prevent damage to darts and accessories.

Another object of this invention is to provide a device to keep darts and accessories organized.

It is another object of this invention to provide a device that makes the darts and accessories easy to access.

Other objects and advantages of this invention will become apparent and obvious from a study of the following description and the accompanying drawings which are merely illustrative of such invention.

Drawings - Reference Numerals

| | | | |
|---|---|---|---|
| 20 | shelf | 21 | wall mount |
| 22 | mounting holes | 23 | edge |
| 24 | dart storage holes | 25 | flight slots |
| 26 | shaft holes | 27 | recessed cut- out |
| 28 | hooks | 29 | top |
| 30 | underside | 31 | front |

DETAILED DESCRIPTION OF THE INVENTION

Figure 1:
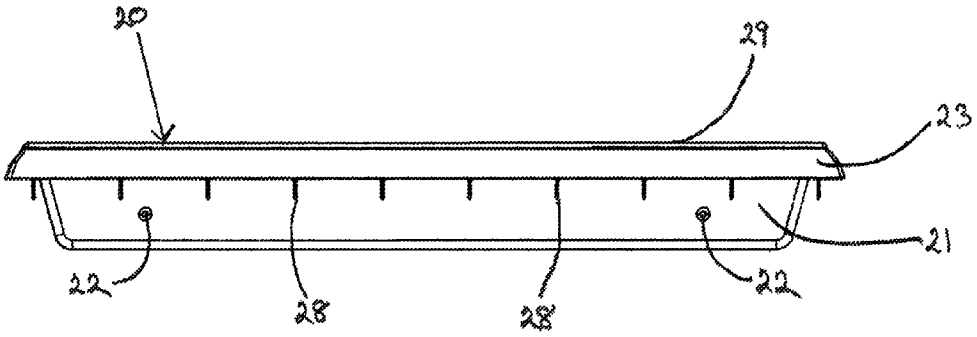
FIG. 1 is a front view of Darts and Accessories Display Shelf.

The Dart and Accessories Display Shelf of the present invention depicted in FIG. 1 comprises a shelf 20 and a wall mount 21 that are joined together by tongue and groove connection with glue and fasteners.

Figure 2:
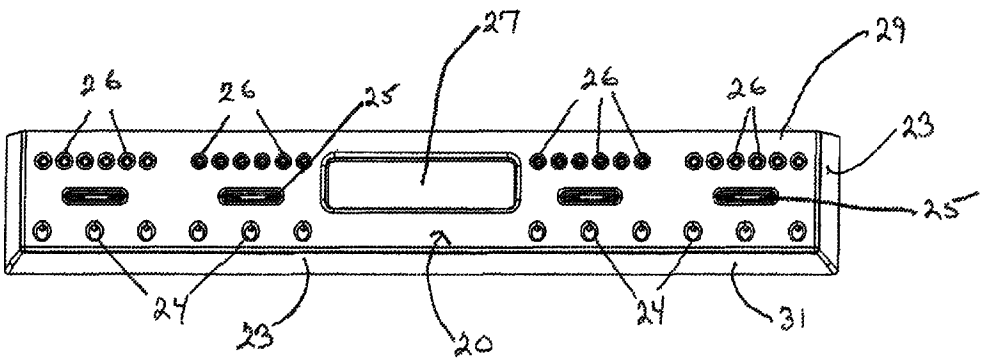
FIG. 2 is a top view of Darts and Accessories Display Shelf.
Figure 3:
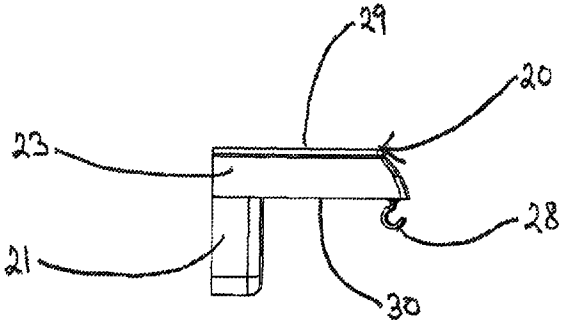
FIG. 3 is a side view of thereof.
Figure 4:
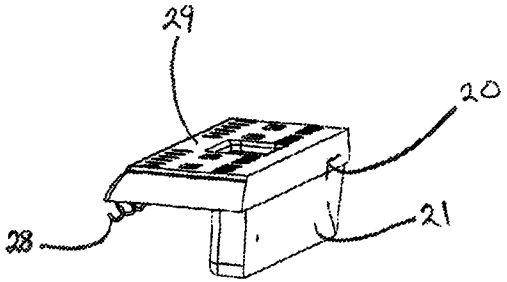
FIG. 4 is a back view of Darts and Accessories Display Shelf.

The shelf 20 is elongated with a rectangular shape and when joined together with the wall mount 21 forms an L shape. The shelf 20 cantilevers out from the wall mount 21 and wall seen in FIG. 3. The wall mount 21 (FIG. 1) has mounting holes 22 that allow the shelf 20 to be installed under the dart cabinet with wall fasteners. As seen in FIG. 3 when installed, the shelf 20 sits flush against the wall. The shelf 20 can be constructed of various woods or molded with plastics. The shelf 20 is designed to store and display darts and accessories that are used to play the game of darts. Located on the shelf 20 top 29 seen in FIG. 2 are various holes and a recessed cut-out 27 for accessories. In FIG. 2 there are dart storage holes 24 to allow for storage of four sets of darts. The dart holes 24 are cylindrical and extend from the top 29 of shelf 20 and passing all the way through the underside 30 (FIG. 3) of the shelf 20. These dart holes 24 (FIG. 2) are drilled at an angle to allow the darts to project out away from the wall, allowing the player to reach for them rather easily. The top 29 section of the dart holes 24 are counter-sunk to allow the dart barrels to be supported and seated in the hole. This takes any stress off of the tips of darts so they do not become bent and damaged.

Located in the center of the shelf 20 seen in FIG. 2 is a recessed cut-out 27 designed to store small accessories that are needed for the game of darts. This recessed cut-out 27 is used for storing chalk that is needed to keep score, a dart wrench which performs many different functions to make repairs to damaged darts, a dart sharpener for dart tips after long periods of use and a chalk board eraser to wipe clean the chalk board after every game.

Seen in FIG. 2 are flight slots 25. They are designed for placement of loose flights so they do not get damaged. The slots 25 (FIG. 2) extend from the top 29 of shelf 20 and pass all the way through the underside 30 (FIG. 3). These slots 25 are cut in the same shape as the flights for them to fit in a precise way. During the game of darts, if you were to damage one of your flights, you would just reach under your dart board and take one from your Darts and Accessories Shelf Display.

Located towards the back of shelf 20 top 29 are shaft holes 26 seen in FIG. 2 These shaft holes 26 are cylindrical holes extending from the top 29 of shelf 20 and part way through the shelf 20. These shaft holes 26 allow you to place the extra shaft pieces that come with your darts when you purchase them, in the shelf 20 for easy access.

Seen in FIG. 3 are hooks 28 located on the underside 30 (FIG. 3) of shelf 20 along the entire front 31 edge 23 (FIG. 1). These hooks 28 (FIG. 3) are made available so that you can store and display your extra flights that you purchase. These flights come in small clear plastic bags in different shapes and designs. They can also be very colorful. The metal hooks are threaded into the underside 30 (FIG. 3) of shelf 20 to keep the flights secure.

Although the description above contain specificities, these should not be constructed as limiting the scope of the embodiment but merely providing illustration of some of the embodiments. For example, the shelf could be set up with different configurations for placement of darts and accessories. The shelf could be built to hold various amounts of darts and accessories. Accordingly, departures may be made from such details without departing from the spirit and scope of the applicants general inventive concept.

I claim:

1. A display shelf comprising:

a rectangular shelf and a wall mount perpendicularly connected to the rectangular shelf and extending downwardly from the rectangular shelf such that the rectangular shelf and the wall mount together form a L-shape, said wall mount having mounting holes for allowing said display shelf to be fastened to a wall with wall fasteners;

said rectangular shelf cantilevers away from said wall mount;

said rectangular shelf having a plurality of linearly arranged darts holes adjacent a front edge of the rectangular shelf, each of the dart holes are cylindrical and extend from a top of the rectangular shelf and pass though an underside of the rectangular shelf, each dart hole being angled with regards to a vertical plane and each of the dart holes being counter-sunk to allow dart barrels to be supported and seated within the dart holes;

said rectangular shelf having a recessed cut-out in a middle of the rectangular shelf;

said rectangular shelf having a plurality of linearly arranged shaft holes located adjacent a rear edge of the rectangular shelf, each of the shaft holes are cylindrical and extend part way through the rectangular shelf, the plurality of linearly arranged shaft holes extending parallel to the plurality of linearly arranged dart holes;

said rectangular shelf having a plurality of linearly arranged slots which are located between the plurality of linearly arranged dart holes and the plurality of linearly arranged shaft holes, each of the slots extends from the top of the rectangular shelf and pass through the underside of the rectangular shelf, each of the slots being in the same shape as flights of darts, and the plurality of linearly arranged slots extending parallel to the plurality of linearly arranged dart holes and the plurality of linearly arranged shaft holes;

said rectangular shelf having a plurality of hooks linearly arranged adjacent the front edge and extending from the underside of the rectangular shelf for storing and display additional flights.

* * * * *